US012768049B2

(12) United States Patent
Englert et al.

(10) Patent No.: US 12,768,049 B2
(45) Date of Patent: Oct. 20, 2026

(54) METHOD FOR PASSIVATING AN ALUMINUM SURFACE PROVIDED WITH A FLUX

(71) Applicant: Mahle International GmbH, Stuttgart (DE)

(72) Inventors: Peter Englert, Bad Friedrichshall (DE); Hans Koch, Ditzingen (DE); Oliver Mamber, Sersheim (DE); Bertram Schoen, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 1226 days.

(21) Appl. No.: 17/560,930

(22) Filed: Dec. 23, 2021

(65) Prior Publication Data

US 2022/0112606 A1 Apr. 14, 2022

Related U.S. Application Data

(63) Continuation of application No. PCT/EP2020/064548, filed on May 26, 2020.

(30) Foreign Application Priority Data

Jun. 26, 2019 (DE) ..... 10 2019 209 249.7

(51) Int. Cl.
*C23C 22/56* (2006.01)
*C23C 22/27* (2006.01)
(Continued)

(52) U.S. Cl.
CPC ..... *C23C 22/56* (2013.01); *C23C 22/27* (2013.01); *C23C 22/28* (2013.01); *C23C 22/34* (2013.01);
(Continued)

(58) Field of Classification Search
CPC ... C23C 22/27–28; C23C 22/34; C23C 22/56; C23C 22/66; C23C 22/68;
(Continued)

(56) References Cited

U.S. PATENT DOCUMENTS 6,306,226 B1 10/2001 Iino et al.
8,216,383 B2 7/2012 Yang et al.
(Continued)

FOREIGN PATENT DOCUMENTS

CA 2695183 * 2/2009 ..... C23C 22/66
CN 1730725 2/2006
(Continued)

OTHER PUBLICATIONS

English Translation of Office Action issued in JP2021-572496 (Oct. 16, 2023).
(Continued)

*Primary Examiner* — Lois L Zheng
(74) *Attorney, Agent, or Firm* — Barnes & Thornburg

(57) ABSTRACT

A method is provided for passivating an aluminum surface. According to the method, the aluminum surface is provided with a flux. A passivation solution is subsequently applied to the aluminum surface, such that a passivation layer is created by reaction of the passivation solution with the aluminum surface, which is provided with the flux.

18 Claims, 1 Drawing Sheet

(51) Int. Cl.

| | |
|---|---|
| ***C23C 22/28*** | (2006.01) |
| ***C23C 22/34*** | (2006.01) |
| ***C23C 22/73*** | (2006.01) |
| ***C23C 22/82*** | (2006.01) |
| ***F28F 21/08*** | (2006.01) |
| *C23C 22/00* | (2006.01) |

(52) U.S. Cl.
CPC ..... *C23C 22/73* (2013.01); *C23C 22/82* (2013.01); *F28F 21/084* (2013.01); *F28F 2245/00* (2013.01)

(58) Field of Classification Search
CPC ..... C23C 22/83; C23C 22/82; B23K 35/3605; F28D 1/05366; F28F 19/02; F28F 21/006; F28F 21/084; F28F 2245/00
See application file for complete search history.

(56) References Cited

U.S. PATENT DOCUMENTS

| | | | | |
|---|---|---|---|---|
| 8,815,022 | B2 | 8/2014 | Yoshida et al. | |
| 9,139,913 | B2 | 9/2015 | Matsui et al. | |
| 9,896,766 | B2 | 2/2018 | Mizuno et al. | |
| 11,377,741 | B2 | 7/2022 | Englert et al. | |
| 2003/0098091 | A1 | 5/2003 | Opdycke et al. | |
| 2006/0118216 | A1* | 6/2006 | Boger ..... | C23C 8/40 148/688 |
| 2007/0163761 | A1 | 7/2007 | Minami et al. | |
| 2014/0005314 | A1 | 1/2014 | Minowa et al. | |
| 2018/0305820 | A1 | 10/2018 | Englert et al. | |

FOREIGN PATENT DOCUMENTS

| | | | | | |
|---|---|---|---|---|---|
| CN | 102134720 | | | 7/2011 | |
| CN | 102762708 | | | 10/2012 | |
| CN | 102892927 | | | 1/2013 | |
| CN | 108728838 | | | 11/2018 | |
| DE | 69811818 | T2 | | 5/2004 | |
| DE | 102017206940 | A1 | | 10/2018 | |
| EP | 911427 | A1 | | 4/1999 | |
| JP | H10-298776 | | | 11/1998 | |
| JP | H11-131254 | | | 5/1999 | |
| JP | 2004-510882 | | | 4/2004 | |
| JP | 2006-069197 | | | 3/2006 | |
| JP | 2011-153739 | | | 8/2011 | |
| JP | 5183837 | B2 | * | 4/2013 | ..... C23C 22/34 |
| JP | 2016-099101 | | | 5/2016 | |
| JP | 2018-185133 | | | 11/2018 | |
| WO | WO 2012/148988 | | * | 11/2012 | ..... F28F 18/00 |

OTHER PUBLICATIONS

English Translation of Search Report issued in CN2020800462451 (Aug. 11, 2023).
Advisory Action from JP Application No. 2021-572496 (Feb. 9, 2024.
Office Action from CN Application No. 202080046245.1 (Jan. 29, 2024).
Examiantion Report JP Application No. 2024-099562 dated Sep. 11, 2025.

* cited by examiner

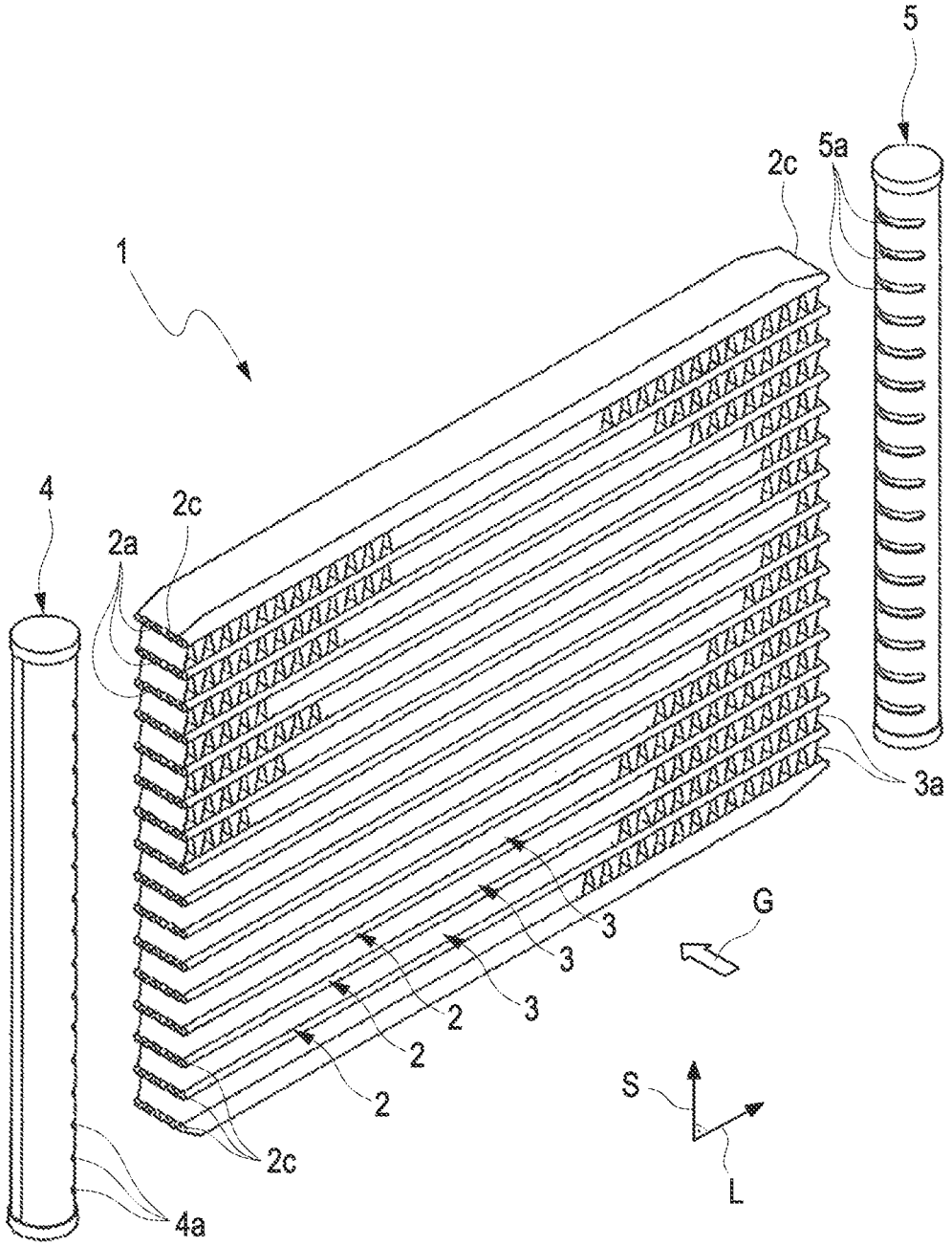
5
5a
2c
1
4
2c
2a
3a
3
3
3
G
2
2
2
S
L
2c
4a

METHOD FOR PASSIVATING AN ALUMINUM SURFACE PROVIDED WITH A FLUX

CROSS REFERENCE TO RELATED APPLICATIONS

This application is a continuation application of international patent application PCT/EP2020/064548, filed May 26, 2020, designating the United States and claiming priority to German application 10 2019 209 249.7, filed Jun. 26, 2019, and the entire content of both applications is incorporated herein by reference.

TECHNICAL FIELD

The disclosure relates to a method for passivating an aluminium surface provided with a flux. The disclosure furthermore relates to a heat exchanger, which is produced by carrying out this method. The disclosure further relates to a motor vehicle comprising such a heat exchanger.

BACKGROUND

It is known to braze aluminum components, wherein fluxes are used. For example, heat exchangers can be made of aluminum, wherein the heat exchanger comprises components, which are connected to one another with a substance-to-substance bond with brazing during the production of the heat exchanger. Heat exchangers for motor vehicles are usually brazed with the so-called Controlled Atmosphere Brazing (CAB) soldering method, wherein potassium-aluminum fluoride is used as flux.

However, free fluorides of this flux can lead to a corrosion of the aluminum. The free fluorides can furthermore attack additives of a coolant received in the heat exchanger in such a way that a formation of voluminous aluminum hydroxides occurs, which can block or even close coolant paths in the heat exchanger. Due to the formed aluminum hydroxides, the electric conductivity of the coolant can additionally increase in such a way that dangerous charge quantities are distributed to the motor vehicle via a cooling cycle, which guides the coolant, or a water electrolysis with explosive gas formation takes place in the case of an aqueous coolant. This applies in particular to electric motor vehicles comprising fuel cells, such as hydrogen fuel cells or metal-air fuel cells.

SUMMARY

It is an object of the present disclosure to provide an improved or at least alternative method for passivating an aluminum surface provided with a flux, which takes into account the above-mentioned problem. Components of aluminum with a high corrosion resistance are to in particular be produced with such a method.

This object is achieved by a method for passivating an aluminum surface provided with a flux, a heat exchanger, and a motor vehicle as described herein.

It is thus a general idea of the disclosure to bind flux residues, which are present on an aluminum surface after a soldering process, with a passivation solution, so that the flux residues cannot interact with a coolant, which is guided through the heat exchanger during operation, and to furthermore create a corrosion-resistant passivation layer in the region of the aluminum surface. Particularly low electric conductivities of a coolant, which is received in a heat exchanger, in particular of below 50 μS/cm or even of below 20 μS/cm, are attained in this way, and an explosive gas formation in the coolant is avoided. Furthermore, a compact passivated corrosion-resistant aluminum surface is provided. A complex removal of the flux residues and solder residues, which is associated with disadvantages, is thus not required.

A method according to the disclosure serves for passivating an aluminum surface provided with a flux. According to the method, the aluminum surface provided with the flux is provided. A passivation solution is subsequently applied to the provided aluminum surface, so that a passivation layer is created by reaction of the passivation solution with the aluminum surface, which is provided with the flux.

The aluminum surface is advantageously passivated with heating and pressurizing, typically in an autoclave, after the application of the passivation solution. The reaction of the passivation solution with the aluminum surface, which is provided with the flux, takes place particularly effectively in this way, so that a particularly compact and thus corrosion-resistant passivation layer is created.

According to an exemplary embodiment, the aluminum surface is heated to a temperature of more than 100° C., typically of more than 120° C. In the case of this embodiment, the reaction of the passivation solution with the aluminum surface, which is provided with the flux, also takes place particularly effectively, and a particularly compact and thus corrosion-resistant passivation layer is created.

The same applies to a further exemplary embodiment, in the case of which the aluminum surface is pressurized with a pressure of more than 1 bar and maximally 2 bar. The reaction of the passivation solution with the aluminum surface, which is provided with the flux, also takes place particularly well in this way, and a particularly compact and thus corrosion-resistant passivation layer is created.

According to an advantageous embodiment, the provided flux is or comprises potassium-aluminum fluoride. In the case of this embodiment, a particularly compact passivation layer is created in the region of the aluminum surface.

The applied passivation solution is typically produced by mixing a zirconium solution with a water glass dispersion. In the case of this embodiment, a particularly large amount of flux is bound on the aluminum surface, and a particularly compact and thus corrosion-resistant passivation layer is created in the region of the aluminum surface.

According to an exemplary embodiment, the zirconium-silicate solution contains 0.1 g-5 g/L of zirconium silicate. A particularly large amount of flux is bound on the aluminum surface in this way, and a particularly compact and thus corrosion-resistant passivation is thus created in the region of the aluminum surface.

The zirconium-silicate solution is typically produced by dissolving zirconium carbonate in a sulfuric acid solution with a pH value of 2 to 6 and subsequent neutralizing with ammonia. A particularly large amount of flux is bound on the aluminum surface in this way, and a particularly compact and thus corrosion-resistant passivation layer is created in the region of the aluminum surface.

According to a further exemplary embodiment, the zirconium-silicate solution contains sebacic acid with a concentration of 0.1 to 2%.

The zirconium-silicate solution can furthermore also contain sebacic acid with a concentration of 0.1 to 2% and, in the alternative or in addition, triethanolamine with a concentration of 0.05 to 0.5%. It is also conceivable that the zirconium-silicate solution contains other dicarboxylic acids, such as, for example, tartaric acid.

In the case of a further development, the passivation solution contains tartaric acid. The passivation solution particularly typically contains 3 to 5 grams of tartaric acid per liter of passivation solution. Such a passivation solution is particularly effective.

According to a further exemplary embodiment, the zirconium-silicate solution contains triethanolamine with a concentration of 0.05 to 0.5%. With these two measures, alone or in combination, a particularly large amount of flux is also bound on the aluminum surface, and a particularly compact and thus corrosion-resistant passivation layer is created in the region of the aluminum surface.

The zirconium solution advantageously contains at least one corrosion inhibitor with a share of 0.005 to 10% by weight, typically 0.01 to 2.0% by weight, wherein the at least one corrosion inhibitor comprises catechol-3,5-disulfonic acid disodium salt, diethylene triamine pentaacetic acid, 8-hydroxy-(7)-iodchinolin-sulfonic acid-(5), 8-hydroxy-chinolin-5-sulfonic acid, mannitol, 5-sulfosalicylic acid, aceto-O-hydroxamic acid, norepinephrine, 2-(3,4-dihydroxyphenyl)-ethylamine, L-3,4-dihydroxyphenylalanine (L-DOPA), 3-hydroxy-2-methyl-pyrane-4-on, citrates, carboxylates, in particular oxylates, alkali salts of stearate, formate, glyconat, sodium tetraborate, pyrophosphoric acid, and, in the alternative or in additions, calcium gluconate. This embodiment creates a particularly corrosion-resistant passivation layer.

The water glass dispersion particularly typically contains water glass with a concentration of 5 to 25%. A particularly large amount of flux is also bound on the aluminum surface in this way, and a particularly compact and thus corrosion-resistant passivation layer is created in the region of the aluminum surface.

According to an exemplary embodiment, the water glass dispersion contains calcium gluconate with a concentration of 0.5 to 2%. A particularly large amount of flux is also bound on the aluminum surface in this way, and a particularly compact and thus corrosion-resistant passivation layer is created in the region of the aluminum surface.

According to an advantageous embodiment, the applied passivation solution contains hexafluorozirconic acid. A particularly large amount of flux is also bound on the aluminum surface in this way, and a particularly compact and thus corrosion-resistant passivation layer is created in the region of the aluminum surface.

According to a further advantageous embodiment, the applied passivation solution contains polyurethane dispersions and, in the alternative or in addition, ammonium vanadates. A particularly large amount of flux is also bound on the aluminum surface in this way, and a particularly compact and thus corrosion-resistant passivation layer is created in the region of the aluminum surface.

The provided aluminum surface is advantageously part of a heat exchanger, which comprises several components made of aluminum, which are connected to one another with at least one soldered joint, typically with at least one brazed joint. The aluminum surface can be passivated easily and efficiently in this way with introduction of the passivation solution into the heat exchanger.

The disclosure further relates to a heat exchanger comprising several components made of aluminum, which are connected to one another with at least one soldered joint, typically with at least one brazed joint, wherein the aluminum surface of at least one component is passivated with the method according to the disclosure. The above-described advantages of the method according to the disclosure thus also transfer to the heat exchanger according to the disclosure.

The disclosure further relates to a motor vehicle, which comprises an above-introduced heat exchanger. The above-described advantages of the method according to the disclosure and of the heat exchanger according to the disclosure thus also transfer to the motor vehicle according to the disclosure.

Further important features and advantages of the disclosure follow from the drawing and from the corresponding FIGURE description on the basis of the drawing.

It goes without saying that the above-mentioned features and the features, which will be described below, cannot only be used in the respective specified combination, but also in other combinations, or alone, without leaving the scope of the present disclosure.

BRIEF DESCRIPTION OF THE DRAWINGS

The disclosure will now be described with reference to the drawings wherein:

FIG. 1 shows a heat exchanger according to an exemplary embodiment of the disclosure.

DESCRIPTION OF EXEMPLARY EMBODIMENTS

FIG. 1 shows a simplified illustration of a heat exchanger 1 according to an exemplary embodiment of the disclosure, in particular for an electric motor vehicle. The heat exchanger 1 comprises a plurality of tubular bodies 2, which extend along a longitudinal direction L and through which a coolant K can flow. Along a stack direction S perpendicular to the longitudinal direction L, the tubular bodies 2 are arranged at a distance from one another. In the exemplary embodiment shown in FIG. 1, 16 tubular bodies 2 are shown in an exemplary manner. It goes without saying that a different number of tubular bodies 2 is also possible in alternatives.

The tubular bodies 2 are fluidically connected to a coolant distributor 4 for distributing the coolant K to the tubular bodies 2, and to a coolant collector 5 for collecting the coolant after the flow-through of the tubular bodies 2. For this purpose, the coolant distributor 4 and the coolant collector 5 have slots 4*a*, 5*a* for receiving the longitudinal ends 2*b* of the tubular bodies 2.

The coolant distributor 4 and the coolant collector 5 are arranged in the region of longitudinal ends 2*b* of the tubular bodies 2, which are located opposite one another along the longitudinal direction L. A rib structure 2*a* comprising ribs for guiding the coolant is provided in the tubular bodies 2, at which rib structure the inner surfaces of the tube walls of the tubular bodies 2 are furthermore supported.

Fluid paths 3 for being flown through with a gas G, in particular charge air, are formed with intermediate spaces provided between the tubular bodies 2 along the stack direction S. A rib structure 3*a* (not completely shown in FIG. 1 for the sake of clarity), which comprises ribs for guiding the gas G and on which the outer sides of the tube walls of the tubular bodies 2 adjoining in the stack direction S are furthermore supported, is provided in the fluid paths 3.

The components of the heat exchanger 1, in the exemplary embodiment shown in FIG. 1, which are the tubular body 2, the rib structures 2*a*, 3*a*, the coolant distributor 4, and the coolant collector 5, comprise aluminum as material or consist of aluminum.

As part of the production of the heat exchanger 1, these individual components of the heat exchanger 1 are soldered to one another, namely brazed, at respective contact points 10 by using potassium-aluminum fluoride as flux, and are thus connected to one another with a substance-to-substance bond. Alternatively to potassium-aluminum fluoride, a different flux containing fluorides can also be used.

Said contact points 10 exist between the respective tubular bodies 2 and the coolant distributor 4 as well as the coolant collector 5, because the tubular bodies 3 are brazed to the coolant distributor 4 as well as to the coolant collector 5. Due to the fact that the rib structures 2*a*, 3*a* are brazed to the tubular bodies 3, such contact points 10 are also provided between the rib structures 3*a* and the tubular bodies 3.

The method according to the disclosure will be described below using the example of the heat exchanger 1:

After the brazing of the above-mentioned aluminum components of the heat exchanger 1—by using a flux—these components are provided for the method according to the disclosure. This means that the aluminum surfaces of said components are also provided in the region of the contact points 11. Due to the fact that coolant flows through the tubular bodies 3 comprising the rib structures 3*a* as well as the coolant distributor 4 and the coolant collector 5 during the operation of the heat exchanger 1, so that the coolant comes into contact with the aluminum surface, the aluminum surface is passivated with the method according to the disclosure.

For this purpose, a passivation solution is applied to the provided aluminum surfaces, so that a passivation layer is created by reaction of the passivation solution with the aluminum surfaces, which are provided with the flux. In the exemplary embodiment of the heat exchanger 1, this can be attained with introduction of the passivation solution into the coolant distributor 4, into the tubular bodies 2, and into the coolant collector 5.

The passivation solution is produced with mixing a zirconium-silicate solution with a water glass dispersion.

The zirconium-silicate solution contains 0.1-5 g/L of zirconium silicate. The zirconium-silicate solution is produced with dissolving zirconium carbonate in a sulfuric acid solution with a pH value of 2 to 6, subsequent neutralizing with ammonia. Alternatively to the zirconium-silicate solution, a solution of a different fluoride-complexing element, such as, for example, lanthanum, can also be used.

The zirconium-silicate solution can furthermore also contain sebacic acid with a concentration of 0.1 to 2% and, in the alternative or in addition, triethanolamine with a concentration of 0.05 to 0.5%. It is also conceivable that the zirconium-silicate solution contains other dicarboxylic acids, such as, for example, tartaric acid.

The passivation solution can contain tartaric acid. The passivation solution can contain, for example, 3 to 5 grams of tartaric acid per liter of passivation solution.

The zirconium-silicate solution additionally contains the corrosion inhibitor catechol-3,5-disulfonic acid disodium salt with a share of 0.01 to 2.0% by weight. It is also conceivable, however, that the zirconium-silicate solution, in the alternative or in addition, contains one or several of the substances disodium salt, diethylene triamine pentaacetic acid, 8-hydroxy-(7)-iodchinolin-sulfonic acid-(5), 8-hydroxy-chinolin-5-sulfonic acid, mannitol, 5-sulfosalicylic acid, aceto-O-hydroxamic acid, norepinephrine, 2-(3,4-dihydroxyphenyl)-ethylamine, L-3,4-dihydroxyphenylalanine (L-DOPA), 3-hydroxy-2-methyl-pyrane-4-on, citrates, carboxylates, in particular oxylates, alkali salts of stearate, formate, glyconat, sodium tetraborate, pyrophosphoric acid, or calcium gluconate.

The water glass dispersion contains water glass with a concentration of 5 to 25%. The water glass can thereby be sodium silicate, lithium water glass, or potassium water glass. The water glass dispersion furthermore contains calcium gluconate with a concentration of 0.5 to 2%.

The passivation solution can also contain hexafluorozirconic acid. It is also conceivable that the passivation solution contains polyurethane dispersions. The passivation solution can also contain ammonium vanadates.

After the application of the passivation solution, the heat exchanger is introduced into an autoclave, and the aluminum surfaces, which are provided with the flux, are passivated with heating and pressurization. The aluminum surfaces are thereby heated to a temperature of more than 120° C. The aluminum surfaces are furthermore pressurized with a pressure of more than 1 bar and maximally 2 bar.

Other aluminum surfaces, which are provided with flux, can likewise be passivated in the above-specified manner.

It is understood that the foregoing description is that of the exemplary embodiments of the disclosure and that various changes and modifications may be made thereto without departing from the spirit and scope of the disclosure as defined in the appended claims.

What is claimed is:

1. A method for passivating an aluminum surface provided with a flux, the method comprising:

(a) providing the aluminum surface provided with the flux; and (b) applying a passivation solution to the aluminum surface provided in step (a), such that a passivation layer is created by reaction of the passivation solution with the aluminum surface, which is provided with the flux, wherein the passivation solution applied in step (b) is produced by mixing a zirconium solution with a water glass dispersion, wherein the passivation solution is a zirconium-silicate solution that contains 0.1-5 g/L of zirconium silicate, and wherein the water glass dispersion contains water glass with a concentration of 5 to 25%.

2. The method according to claim 1, wherein the aluminum surface is passivated with heating and pressurizing, after the application of the passivation solution.

3. The method according to claim 2, wherein the aluminum surface is heated to a temperature of more than 100° C.

4. The method according to claim 2, wherein the aluminum surface is pressurized with a pressure of more than 1 bar and maximally 2 bar.

5. The method according to claim 1, wherein the flux provided in step (a) comprises or is potassium-aluminum fluoride.

6. The method according to claim 1, wherein:

zirconium-silicate solution contains sebacic acid with a concentration of 0.05 to 2%.

7. The method according to claim 6, wherein the zirconium-silicate solution contains triethanolamine with a concentration of 0.05 to 0.5%.

8. The method according to claim 1, wherein:

the zirconium-silicate solution contains at least one corrosion inhibitor with a share of 0.005 to 10% by weight by weight, and the at least one corrosion inhibitor comprises catechol-3,5-disulfonic acid disodium salt, diethylene triamine pentaacetic acid, 8-hydroxy-(7)-iodchinolin-sulfonic acid-(5), 8-hydroxy-chinolin-5-sulfonic acid, mannitol, 5-sulfosalicylic acid, aceto-O-hydroxamic acid, norepinephrine, 2-(3,4-dihydroxyphenyl)-ethylamine, L-3,4-dihydroxyphenylalanine (L-DOPA), 3-hydroxy-2-methyl-pyrane-4-on, citrates, carboxylates, oxylates, alkali salts of stearate, formate, glyconat, sodium tetraborate, pyrophosphoric acid, and/or calcium gluconate.

9. The method according to claim 1, wherein the water glass dispersion contains calcium gluconate with a concentration of 0.5 to 2%.

10. The method according to claim 1, wherein the passivation solution applied in step (b) contains hexafluorozirconic acid.

11. The method according to claim 1, wherein the aluminum surface provided in step (a) is part of a heat exchanger, which comprises a plurality of components made of aluminum, which are connected to one another with at least one soldered joint.

12. The method according to claim 1, wherein the zirconium-silicate solution contains tartaric acid.

13. The method of claim 1, wherein the water glass dispersion is sodium silicate.

14. A method for passivating an aluminum surface provided with a flux, the method comprising:

(a) providing the aluminum surface provided with the flux; and (b) applying a passivation solution to the aluminum surface provided in step (a), such that a passivation layer is created by reaction of the passivation solution with the aluminum surface, which is provided with the flux, wherein the passivation solution applied in step (b) is produced by mixing a zirconium solution with a water glass dispersion, wherein the water glass dispersion contains water glass with a concentration of 5 to 25%.

15. A method for passivating an aluminum surface provided with a flux, the method comprising:

(a) providing the aluminum surface provided with the flux; and (b) applying a passivation solution to the aluminum surface provided in step (a), such that a passivation layer is created by reaction of the passivation solution with the aluminum surface, which is provided with the flux, wherein the passivation solution applied in step (b) contains polyurethane dispersions and/or ammonium vanadates, and wherein the passivation solution further contains a water glass dispersion.

16. The method of claim 15, wherein the passivation solution is produced by mixing a zirconium solution with the water glass dispersion.

17. A method for passivating an aluminum surface provided with a flux, the method comprising:

(a) providing the aluminum surface provided with the flux; and (b) applying a passivation solution to the aluminum surface provided in step (a), such that a passivation layer is created by reaction of the passivation solution with the aluminum surface, which is provided with the flux, wherein the passivation solution contains 5 to 30 grams of tartaric acid per liter of passivation solution, and wherein the passivation solution further contains a water glass dispersion.

18. The method of claim 17, wherein the passivation solution is produced by mixing a zirconium solution with the water glass dispersion.

* * * * *